United States Patent [19]

Prohaska

[11] Patent Number: 4,564,116

[45] **Date of Patent: * Jan. 14, 1986**

[54] CLOSURE CAP FOR BEVERAGE CONTAINERS

[75] Inventor: Helmut Prohaska, Pöttenberg, Austria

[73] Assignee: Folienwalzwerk Bruder Teich Aktiengasellschaft, Wien, Austria

[ * ] Notice: The portion of the term of this patent subsequent to Feb. 14, 2001 has been disclaimed.

[21] Appl. No.: 448,895

[22] PCT Filed: Apr. 8, 1982

[86] PCT No.: PCT/EP82/00082

§ 371 Date: Dec. 8, 1982

§ 102(e) Date: Dec. 8, 1982

[87] PCT Pub. No.: WO82/03612

PCT Pub. Date: Oct. 28, 1982

[30] Foreign Application Priority Data

Apr. 10, 1981 [DE] Fed. Rep. of Germany ..... 3114613

[51] Int. Cl.[4] ..... B65D 41/42

[52] U.S. Cl. ..... 215/256; 215/250; 215/262; 215/307; 220/231; 220/271; 220/276

[58] Field of Search ..... 215/254, 256, 262, 250, 215/253, 255, 307, 310, 305, 260; 220/231, 271, 276

[56] References Cited

U.S. PATENT DOCUMENTS

| | | | |
|---|---|---|---|
| 2,218,040 | 10/1940 | Hutoff, Jr. | 215/254 |
| 2,238,105 | 4/1941 | Fison | 215/305 |
| 3,283,935 | 11/1966 | Samuels et al. | 215/256 |
| 3,301,426 | 1/1967 | Kavalus | 215/254 |
| 3,338,446 | 8/1967 | Faulstich | 215/256 X |
| 3,392,862 | 7/1968 | Faulstich | 215/254 |
| 3,416,687 | 12/1968 | Arnaud | 215/255 |
| 3,425,580 | 2/1969 | Brockhage | 215/305 |
| 3,782,576 | 1/1974 | Jacquemijns | 215/262 X |
| 3,809,280 | 5/1974 | Park et al. | 215/310 |
| 3,958,710 | 5/1976 | Harding et al. | 215/254 |
| 3,963,140 | 6/1976 | Harding | 215/254 |
| 3,974,931 | 8/1976 | Moller | 215/254 |
| 4,003,488 | 1/1977 | Moller | 215/254 |
| 4,069,936 | 1/1978 | Ota | 215/256 |
| 4,256,233 | 3/1981 | Harding | 215/254 |
| 4,431,111 | 2/1984 | Prohaska | 215/256 |

FOREIGN PATENT DOCUMENTS

| | | | |
|---|---|---|---|
| 456086 | 3/1950 | Italy | 215/305 |

*Primary Examiner*—Allan N. Shoap
*Assistant Examiner*—Bryan Gehman
*Attorney, Agent, or Firm*—Silverman, Cass & Singer

[57] ABSTRACT

A bottle closure cap stampable from sheet metal as a shallow cylindrical inverted dish having a rounded juncture forming a fillet between its crown and its cylindrical wall; a layer of elastomeric material being disposed in the fillet and engageable with the axial end of the bottle when the cap is attached. A generally radially extending rip tab is integral with the cylindrical wall at the bottom edge thereof and is adapted to tear through the cylindrical wall by a generally circumferential pull of the user to gain access to the container. A rip line is provided commencing at a corner defined by the bottom edge of the cylindrical wall where it meets the rip tab. At least one groove is formed in the rip tab extending in the inner surface of the side wall. The rip line extends at a shallow angle across the cylindrical wall, without crossing the groove, continuing to a level which is spaced below the crown, continuing parallel to the crown circumferentially about half-way around the closure cap.

29 Claims, 12 Drawing Figures

CLOSURE CAP FOR BEVERAGE CONTAINERS

FIELD AND BACKGROUND OF THE INVENTION

The field of the invention is closure caps for containers and more particularly is the provision of a novel closure cap which is formed of thin sheet metal and is adapted to be installed onto the top of a beverage bottle of glass or plastic.

Although not limited thereto, the closure cap of the invention is especially intended for use with glass bottles that are used world wide for containing soft drinks and brewed beverages such as beer and ale. The design and dimensions of the open end of such bottle has been fairly standardized and is designated by the standard DIN6094 in foreign countries, such open end or so-called mouthpiece having a beaded outer rim with an exterior diameter of 26.5 mm.

So far as known there is no commercially available closure cap which is reliably capable of relieving the pressure within a beverage container without blowing off the closure cap. Bottled beverages consist generally of two types, those which are gaseous and those which are still. Both types may be required to pass through autoclaves for pasteurization purposes and thereby are subjected to high pressures produced by the elevated temperatures that are involved. Pasteurization of beer, for example, is effected at a temperature of about 72° C. in which the internal pressure of a container will rise to well over 10 bars (one bar equals 1 megadyne per square centimeter) for a beverage that has about 4 or more grams of carbon dioxide per liter dissolved in the liquid.

In the case of sterilizing liquids which are not gaseous, the autoclave temperatures are from about 123° C. to 133° C. and are maintained at this temperature for up to 40 minutes. Thus, the pressures can and usually do rise to values which can burst containers. This is especially true in the case of glass bottles which are of the refillable type. Fatigue and weaknesses in used bottles are difficult to detect and the result of breakage is loss of the contents in addition to the inconvenience of removing the broken materials from the machinery.

Gaseous beverages such as soft drinks and beer frequently are also subjected to high pressures during storage and transportation and even while in the possession of the user. Heat and agitation of the container will increase the internal pressure and can result in explosions of the containers. There are losses of containers and contents in transportation, storage and even in sales outlets where ambient conditions result in high temperatures. As for the explosion of containers in the possession of users, this is most common with used containers but occurs with new containers as well. There is always a danger to the user of carbonated beverages and, as a consequence, a constant source of expense for bottlers who are required to provide insurance and defend against lawsuits for injuries.

Another problem with prior closure caps has been the crazing and chipping caused by the application of the closure cap to the container and such damage caused by the user when opening the same. This is especially true with the so-called crown caps that are crimped in place with multiple dimples or crimps and which require a bottle opener to remove the same.

There is another disadvantage of prior closure caps of all kinds which is encountered during the opening of the container to gain access to the contents. The counters are under pressure and the degree of pressure is dependent upon the temperature and the amount of agitation to which the container has been subjected the act of opening the container is accepted as adventuresome by users because there is no way of controlling the release of pressure. It can be gradual or explosive, the latter being the most commonly encountered type of relief. The contents of the container may be expelled during the opening to varying degrees causing inconvenience and annoyance also, and the closure cap may fly up dangerously.

It has been difficult if not totally impractical to apply closure caps of a type which are applied by axial engagement to plastic bottles because of the danger of crushing the bottle or collapsing its neck. Therefore, plastic bottles designed to contain beverages generally are provided with screw type upper ends which require expensive screwcap types of closures and special machinery for installation. The cost of the bottles as well as the cost of the closure caps in increased.

There are several types of closure caps besides the crown cork crimped or the crown cork twist-off types which are used on bottles and each has its disadvantages. These are variously known as "Alka", "Rip Cap" and "Maxicap". The latter two have parallel rip lines which pass over the top or crown of the closure so that the user must either pull the tab all the way to divide the closure into three pieces or he must manipulate the cap parts to separate them for removal from the bottle in order to gain access to the contents. There is no need to describe the inconvenience and difficulties with such closure caps. Manipulation of the cut-open parts can result in finger injuries.

The type of closure cap which has been referred to as "Alka" is characterized by a pull tab and a weakened rip line that tears away a portion of the wall of the cap requiring the user to manipulate the remainder of the cap from the bottle.

In the crown cork type of closure cap the sides of the closure cap are ribbed or crimped making it difficult to carry graphic material legibly thereon.

SUMMARY OF THE INVENTION

The invention overcomes the disadvantages mentioned. A closure for a beverage bottle of the type which has an upper beaded rim and the cap being formed of thin bendable sheet metal in a configuration which is a inverted dish-like member having a substantially cylindrical side wall and a crown. There is a rounded junction about the upper part of the dish-like member which is the corner of the side wall and the crown and which forms an interior fillet. A layer of gasket material is adhered inside the dish-like member in the fillet extending less than the full extent downward on the side wall and preferably only part way on the interior of the crown whereby to form an annular ring of such material. The ring is adapted to be sealingly engaged against the axial end of the beaded rim of the bottle when the closure cap is installed on the bottle.

There is a rip tab connected to the side wall at the bottom edge thereof and extending outwardly of the side wall generally horizontally when the closure cap is formed and before installation and extending generally downwardly and over the bulge of the bottle below the rim when the closure cap is installed on the bottle.

A rip line is coined in the inner surface of the side wall during formation of the closure cap and commences at the corner defined by the meeting of one side edge of the rip tab and the bottom edge of the side wall, extending on a shallow angle upwardly and circumferentially around the side wall past the other side edge of the rip tab to a continuation part which is spaced slightly below the crown and substantially parallel with the crown. The complete extent of the rip line is about half way around the side wall, preferably terminating on the same level as the continuation part. Under certain circumstances the rip line may have its central part, that is between its ends, extend into the rounded junction to ensure venting during opening.

The dish-like member and rip tab are formed integrally, preferably by punching and drawing, from sheet metal, preferably aluminum or aluminum alloy, during the course of which there may be strain hardening.

For reliable relief of pressure there is further at least one groove on the inner surface of the side wall of the closure cap, which groove, however, does not cross the rip line at a substantially acute angle. Preferably the angle defined at the intersection of the rip line and the groove should be than 75°. Otherwise there is the danger tearing along the rip line will follow the groove in lieu of the rip line.

The closure cap is installed upon the bottle by a collet-like tool with fingers that engage the side wall while pressing the crown against the axial end of the bottle rim to effect a seal between the gasket material and the said axial end. The fingers form the side wall into a configuration which follows the contours of the beaded rim closely so that the bottom edge of the side wall is crimped into the groove which is formed between the beaded rim and the bulge that is provided below that rim on the conventional beverage bottle.

There may be additional strain hardening during the installation. In any event the material of the installed closure cap is of such resilience that it is capable of relieving excess pressure within the bottle by self-venting and then resealing itself, such occurring at predetermined pressures. There may be one or more passageways formed by the groove in the side wall in the vicinity of the rip tab to provide controlled pressure relief during the opening of the bottle.

The bottle is opened simply by pulling the rip tab in a circumferential movement and separating a portion of the side wall from the main body of the closure cap, this portion comprising a strip alongside the lower edge of the side wall extending about halfway around the closure cap.

This simple appearing closure cap and the installed cap itself have attributes which provide economy, safety and efficiency. Among these are its ability to selfvent and reseal; its ease of installation; its ease of removal; its ability to release pressure while it is being removed from the bottle; and many other benefits.

Closure caps made according to the invention can be made to self-vent for a typical closure cap at pressures as much as 10 bars, the venting having no effect upon the subsequent sealing of the container. The pressure within the container thus drops to as low as 5 bars or so and upon buildup will again vent without adverse effects. Breakage and loss of contents thereby are reduced if not eliminated during the pasteurization of the bottled beverages. The invention also enable closure caps to be made for self-venting and sealing at pressures which are substantially lower than 10 bars. Therefore, the closure caps of the invention will vent long before the breaking point of the container thereby saving the container and the contents without interfering with the sterilization process.

Further, closure caps of the invention can be installed onto containers with substantially less axial pressure than prior closure caps. For example, when compared with crown caps, the axial pressure required for reliably sealing the closure caps of the invention is at least 25% less than required for crown caps.

According to another aspect of the invention the disadvantage of adventuresome opening of a container for use is alleviated if not completely eliminated by providing for controlled relief of the internal pressure of the container contents during the opening of the container by the closure cap of the invention.

Another important advantage of the invention is concerned with the inherent self-valving effect of the closure cap which occurs during the period when the container carrying the closure cap is pasteurized or heated for other purposes at temperatures which are below that required to sterilize the contents. This advantage is that the valving effect enables the discharge of some of the air which may have been included with the contents during filling. If not replaced by the gases in the liquid contents a slight vacuum may retain above the liquid. In either event the growth of bacteria of the aerobic type is inhibited.

Another advantage is that the axial pressure used to install the closure cap of the invention is so low that the successful application of said cap to plastic bottles is a reality. The need for expensive screwcap types of closures thus is eliminated along with the possibilities that the cap may be removed illegally and other contents substituted in whole or in part. The closure cap of the invention is wholly pilfer-proof because the closure cap is physically and obviously altered in the act of removal.

Last not least, the closure cap of the invention is simple and effective to operate because it is easily removed by a single circumferential movement which so fully loosens the cap that it is easily picked off by the user. Notwithstanding this, the cap is still capable of being replaced onto the bottle and will remain in place whereby the contents may be kept clean for a time. The pressure is not retained after opening but the bottle can be covered by the closure cap sufficient to protect the contents temporarily.

The closure cap of the invention is preferably made out of aluminum or an aluminum alloy. Accordingly it is light in weight and rust-proof. Other thin sheet metals could be used with advantage if properly formed and installed as will be explained hereinafter. Steel would have to be lacquered or otherwise coated to prevent rust; hence the aluminum closure cap is preferred.

Especially in the case of aluminum closure caps according to the invention, application is rapid and the forces required are less than in the case of the ordinary closure caps made out of steel.

The side wall of the closure cap of the invention is smooth with a minimum of wrinkles which provides much space for graphic material in addition to eliminating sharp protruding edges which could cause injuries.

Many other advantages and attributes of the invention will become obvious as a description of the preferred embodiments is set forth hereinafter.

BRIEF DESCRIPTION OF THE DRAWING

Referring to FIG. 1, there is illustrated a closure cap 10 constructed according to the invention. There is an inverted cylindrical dish-like formation which is comprised of a cylindrical side wall 12, a crown 14 which is a flat planar disc, and a rounded annular juncture 16 between the crown 14 and the side wall 12 to form a fillet 13 on the interior of the closure cap 10. Fillet 13 is provided with a layer of gasket material shown at 18, the gasket material being generally elastomeric and specifically being a compound based on polyethylene, PVC or other thermoplastic materials which are resilient at the temperatures to which cold beverages are normally kept and which are not fluid at the temperatures to which beverages are normally subjected during pasteurization and sterilization. The preferred material is a type of so-called plastic foam that is run into the fillet in liquid form and then cured by baking.

Figure 1:
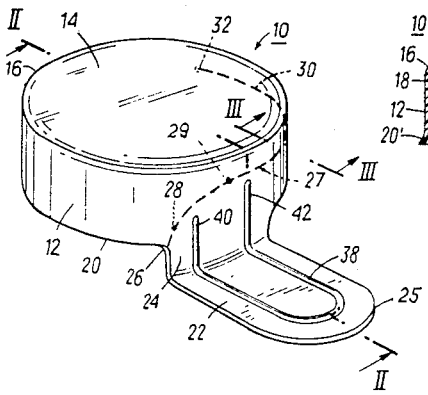
FIG. 1 is a perspective view of a closure cap constructed in accordance with the invention and shown prior to installation onto the top of a bottle or the like container.

The gasket material 18 does not extend to the bottom edge of the side wall 12 and does not extend radially inward of the bottom surface of the crown 14 much beyond the distance which will bring the annular layer against the upper axial end of the bottle (see FIG. 6 and 7) upon which the closure cap 10 is installed. The sealing achieved by the closure cap 10 of the invention makes it unnecessary to utilize any more gasket material than the layer 18 described although a full disc completely engaging the bottom of the crown 14 could be used.

Figure 2A:
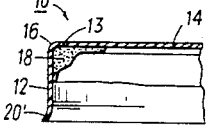
FIG. 2*a* is a fragmentary sectional view of a modified form of the closure cap of FIG. 2.

The bottom edge 20 of the side wall 12 will be turned inwardly by crimping when the closure cap 10 is installed. When the closure cap 10 is formed it is punched and drawn from sheet metal and the drawing process preferably is effected by a simple cylindrical punch and cylindrical cavity. In this manner the resulting side wall 12 is right cylindrical and the bottom edge 20 will lie in the cylindrical plane defined by the side wall 12. If desired the bottom edge may be slightly flaired as shown at 20' in FIG. 2*a* in the case of the closure cap 10. This may assist in piloting the closure cap onto the bottle mouthpiece during installation but is not essential to the invention.

A a rip tab 22 is provided which is integral with the side wall 12 and which normally extends approximately horizontally when the closure cap 10 is formed. The length of the rip tab 22 is chosen to enable the user comfortably to grasp the same for pulling. Also, the rip tab 22 should be long enough to extend past the bulge of the bottle which occurs just below the beaded rim when installed so that the tab will not lay against the bulge and be difficult to pull away from the bulge when it is desired to open the bottle.

The rip tab 22 has a portion 24 which is a continuation of the side wall 12 downwardly to provide some "slack" to enable the closure cap to be crimped in place during installation without unduly distorting the rip tab. Typically for a standard beverage bottle having the outer diameter of the beaded rim as 26.5 mm, the width of the rip tab 22 is 14 mm and its overall length including the portion 24 is about 17 mm. Inasmuch as the circumference of the side wall 12 before installation is almost 84 mm, the connection of the rip tab with the lower edge occupies only a small fraction of its circumference. The end 25 of the rip tab 22 is rounded in the closure cap 10 but could be of any different configuration.

The juncture between the rip tab 22 and the bottom edge 20 of the side wall 12 is preferably rounded as shown at 26 to ensure correct tearing when it is desired to open the bottle.

Figure 2:
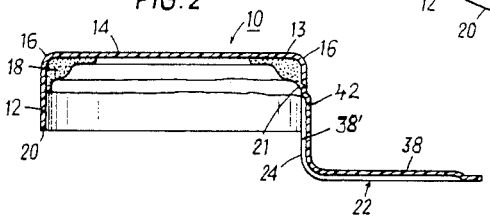
FIG. 2 is a median sectional view taken through the closure cap of FIG. 1 along the plane II—II of FIG. 1 and in the indicated direction.

A rip line 27 is formed provided in the side wall 12. The rip line 27; extends along a path which terminates; approximately halfway around the side wall 12 and is made up of three parts 28, 29, 30 that are continous as shown in FIGS. 1 and 2. The rip line 27 starts at the rounded corner juncture 26. The first part 28 rises at an acute angle relative to a plane taken normal to the center axis of the cap 10. Such plane may be considered as horizontally oriented as compared with said axis. The second part 29 of rip line 27 continues its ascent toward the crown 14 and continues further in a horizontal direction as the third part 30 just below the crown 14 and extends about halfway around the closure cap to terminate thereat. The angle established between a line taken tangent to the ascending rip line and the aforementioned plane should be less than 75°. Preferably, such angle should be less than 45°. Selection of an angle between 15° and 45° is a good practical working example. The part 30 of rip line 27 may be about 2.5 mm or slightly greater below the plane of example between 15° and 45° for a good practical arrangement. The part 30 may be about 2.5 mm below the plane of the crown 14 but should be low enough so that the majority of the layer or ring 18 will not be disturbed. In this way when the closure cap is being removed, the seal will be retained as long as possible. Also there should be a pull strip generated below the rip line 27 that has a width of 2 or 3 mm to resist breaking during the pulling operation.

The rip line 27 extends in a continuum aong the side wall of cap 10 and terminates at a location 32 about halfway around the closure cap 10 covering a distance of between 140° and 180° from its starting location. The termination location 32 is at the same level as the part 30. The length of the rip line 27 is sufficient to enable the closure cap to be easily removed after the line has been traversed and the lower edge of approximately half of the side wall 12 has been pulled away.

Figure 3:
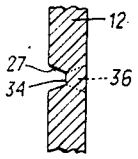
FIG. 3 is a fragmentary sectional view taken through the rip line of the closure cap of FIG. 1 along the line III—III and in the indicated direction.

The rip line 27 is formed in the closure cap 10 during the fabrication of the cap. It is coined into the blank of the sheet metal in the flat before the shape is formed in the drawing dies. The tool for the rip line is preferably one which has a flat end and is tapered to that flat end. The result is a groove such as shown in FIG. 3, the bottom wall of the groove being flat as at 34. It is believed that the area under the groove of the rip line 27 which is indicated at 36 is weakened by cold hardening during the formation of the rip line 27. Accordingly, the material in this area becomes more brittle, making tearing of the rip tab 22 along the rip line 27 easier without weakening the overall strength and hence the sealing ability of the closure cap 10. The groove of the rip line 27 opens to the interior of the side wall 12.

The rip tab 27 has a strengthening rib 38 in the form of a U-shaped protuberance, but the upper ends of the rib at 40 and 42 extend well above the level of the bottom edge 20 for an important purpose. However, as shown in FIG. 1 the rib 40, which is closest to the corner 26 does not cross part 28 or the rip line 27. A groove 38 is formed on the surface of opposite side wall 12 from the rib 38, that is on the interior surface of the side wall 12, the ends 40, 42 however will not extend into the ring 18. The thickness is increased in the region of the ends 40, 42 so that self venting occurs mainly in that region. Thus the closure cap 10 of the invention will self-vent reliably at a predetermined pressure and will reseal itself. Prior closure caps tended to blow off rather than vent reliably such that bottlers would prefer to cap bottles so tightly that the bottles themselves would burst so blow off did not occur.

The venting function can be achieved optimized by the choice of materials combined with the structure, and the method of attaching the closure cap.

Practical examples have been constructed which will vent at pressures between 8 and 10 bars thereafter lowering the pressure within the container to about 5 bars and resealing. Such closure caps were made out of sheet aluminum that had been blanked and formed by drawing using conventional forming techniques. In one example, the aluminum was between 180 and 190 microns thick and had a tensile strength of between 120 and 160 Newtons per $mm^2$. The aluminum itself was about 99% pure. Beverages having an internal pressure of about 5 or 6 bars are the most popular but these will achieve a pressure well over 10 bars when agitated or subjected to heat pressure or both.

In the formation of the closure cap 10 and its installation upon a conventional bottle the procedure is to enclose the closure cap in a suitable fingered collet and lower the collet onto the bottle. The cap is pressed against the axial end of the rim of the bottle by sufficient pressure to deform slightly the compound of the ring 18 mainly elastically. The collet then is contracted around the bead of the rim of the bottle and crimps the lower edge 20 of the side wall 12 into the annular groove between the beaded rim and bulge of the bottle. At the same time the upper corner 16 is caused to conform to the rounded edge of the beaded rim of the bottle by an increase of the radius of curvature of the junction 16.

This action of installation coupled with the effect of forming the closure cap produces a work hardening by cold deformation of the metal which is believed to be substantially uniform around the closure cap. At the same time, there is increased compression of the material of the ring of sealing material. These effects are readily reproduceable and can be controlled by making slight changes in thickness and tensile strength of the aluminum. For aluminum alloys moderate experimentation will enable the proper parameters to be chosen which will give the desired venting effect within a reasonably predictable range of pressures.

It has been found that the venting effect is capable of being achieved with aluminum sheeting of conventional composition with thicknesses between 140 and 250 microns and having tensile strengths between 90 and 220 Newtons per $mm^2$. Preferred ranges are 180 to 220 microns and 130 to 180 Newtons per $mm^2$. The tensile strength mentioned is prior to forming of the closure cap 10. In the process of forming it is believed that there is a strain or work hardening of the aluminum which either of itself or combined with the work hardening during the installation of the closure cap provides a condition to produce the venting described. There is a slight expansion of the closure cap and/or a raising of the cap on the bottle top which permits some of the gas in the top interior of the bottle to escape. The resilience of the work hardened sheet metal of the closure cap 10 thereafter returns the cap to its original sealed condition.

Some examples of aluminum alloys which have produced successful closure caps capable of self-venting are contained in the following table:

| Aluminum | Tensile Strength $N/mm^2$ |
|---|---|
| 3003 soft | 120 |
| 3003 hard | 250 |
| 99,0 soft | 84 (36% elongation) |
| 99,0 hard | 160 (2,7% elongation) |

The venting effect is not required for all beverages after bottling but most of the so-called still beverages which have little or no occluded gases are pasteurized or sterilized at elevated temperatures immediately after bottling. In such cases the ability to vent for relieving pressure produced by the expansion of the air contained in the neck of the bottle above the beverage is desirable to prevent bursting of the bottle in the autoclave.

The closure cap of the invention is advantageous even in cases where the venting capability is not required or used because of its simplicity of construction, ease of application to the bottle top and the ease of removing the closure cap.

Figure 4:
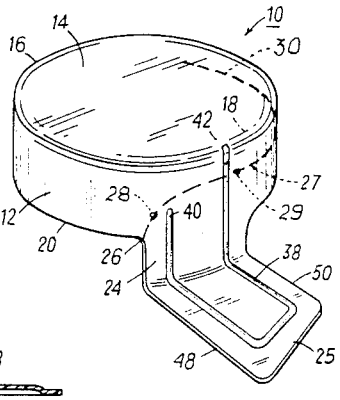
FIG. 4 is a perspective view of a somewhat modified form of the closure cap of FIG. 1.

Referring to FIG. 4, there is illustrated a closure cap 10 but for two exceptions is similar to the closure cap 10 of FIG. 1. First, the free end 25 of the rip tab 22 in the closure cap 10' is substantially squared off yet is arranged at an angle by making the near edge 48 longer than the far edge 50. Thus the user will have a preference for grasping most of the rip tab on the left side and pulling it to the right. Since the rip line 27 commences at the corner 26 which is the juncture of the near edge 48 with the bottom edge 20 of the side wall 12 the tearing of the rip line 27 will commence in the proper direction. This rip line 27 will normally not be visible to the user because it is formed on the interior of the cap. Thus the formation of the rip tab with this angled end 25 is helpful as an aid in the opening of the closure cap.

Secondly, the upper end portion 42 of the U-shaped rib 38 extends upward almost to the crown 14 to provide the sealing ring 18 with a weakened area. The interior groove formed on the backside of the upper end 42 of the rib 38 forms a channel or connection to the rip line 27 from the ring 18. Even though the sealing compound may fill this groove, the upper end 42 of the rib 38 will be the weakest place for escape of pressure from the interior of the bottle when the installed closure cap 10 is opened. The gas from the interior of the bottle will escape so that by the time the rip tab has been fully manipulated the internal pressure has been relieved and the closure cap 10 will not be blown off.

It is not known with certainty whether the path taken by the gas will be between the ring 18 and the bottle end or between the ring 18 and the interior of the fillet 13. The weakness produced by a discontinuation in the uniform pressed engagement at the end 42 of the interior of the rib 38 will relieve gas one way or the other or both. If the ring 18 is not adhered to the interior metal surface of the fillet 13 gas may pass between the ring and metal to the bottom of the groove formed under that end 42.

The second upper end 40 of the rib 38 of closure cap 10 (FIG. 4) does not extend fully up to the juncture 16 and does not cross the rip line 27 in its rising part. Intersection of this end 40 of groove 38 with the rip line is allowed only in its substantially horizontal section 29, 30, if it is desired to provide additional venting during opening of the bottle.

Figure 5:
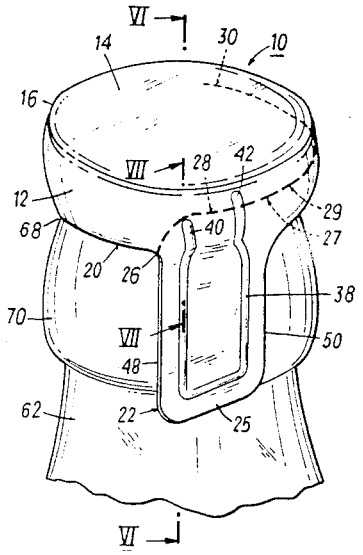
FIG. 5 is a front perspective view of a closure cap constructed in accordance with the invention, said cap being similar to that of FIG. 1 but differing slightly, the closure cap in this view having been installed upon a standard beverage bottle a portion of which is fragmentarily shown.
Figure 6:
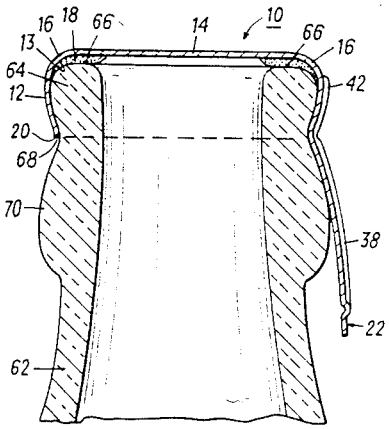
FIG. 6 is a median sectional view taken through the closure cap along the plane VI—VI of FIG. 5 in the indicated direction.
Figure 7:
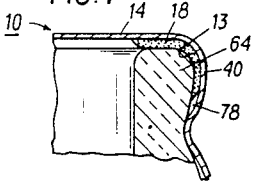
FIG. 7 is a fragmentary sectional view taken generally along the line VII—VII of FIG. 5 and in the indicated direction.

In FIGS. 5, 6 and 7 the cap 10 is illustrated installed upon a standard type of beverage bottle 62 only the upper portion of which is illustrated. The bottle 62 is shown in section by the cross hatching symbol for glass, but plastic beverage bottles can be used also.

The standard bottle 62 has an upper end which provides a beaded rim 64 having an axial end 66 which has a slightly flattened central portion but basically is somewhat rounded. The bottom of the beaded rim 64 turns inwardly and terminates in an annular groove or crease 68 at the neck of the bottle 62. This forms the so-called mouthpiece of the bottle. The bottle has an outward bulge 70 below the groove 68. The configuration of this type of bottle is standard world-wide and in practically all cases the maximum diameter across the bead 64 is 26.5 mm. The interior diameter of the side wall 12 is chosen so that the closure cap 10 can be placed snugly onto the bottle top as the first step of installation. The axial end 66 of the rim is pressed against the gasket ring 18 sufficiently to establish a good seal. The side wall 12 crimped under the beaded rim 64 and its lower edge 20 brought into tight engagement with the groove 68 to lock the closure cap in place. This is performed by use of collet device having a plurality of shaped fingers conforming closely to the contours of the beaded rim 64. The crown 14 of the closure cap is held tightly against the rim end 66, but with much less axial pressure than used for other metal closure. The fingers of the collet are contracted to shape the metal to the contours shown. While this occurs the curvature of the juncture 16 will be shaped to follow the contours of the beaded rim compressing the gasket ring 18. The bottom of the side wall 12 has practically no visible corrugations notwithstanding the crimping action so that graphic material thereon (normally applied to the sheet metal before forming the closure cap) is clearly legible.

During the crimping operation the rip tab 22 is bent downward (as shown in FIG. 6) to overlie the bulge 70 and extend below the bulge making it easy to grasp and manipulate. As stated the angled configuration of the end 25 promotes the tendency for the user to pull the rip tab 22 in the proper direction to tear the closure cap 10 open.

It should be clear that the pressure relief afforded by the invention is automatic and is not concerned with the subsequent opening of the bottle. The controlled relief of pressure which has been mentioned, on the other hand is concerned with the act of opening the bottle and is brought about by the user utilizing the rip tab 22

When the user pulls the rib rab 22 to the right in a generally circumferential movement in order to open the bottle 62, the tearing is initiated at the corner 26, the tearing continues along the upwardly angularly directed rip line 28 until the rib 38 is reached. Looking now at FIG. 7 it can be seen that the underside of the rib 38 define a groove 78 extending to the end 42 of the (rib which in this embodiment does not reach the sealing ring 18). Because end 42 is so much longer than the equivalent end in FIG. 1, there is an increase in the number of plies in the side wall material the plies extend reach to the sealing ring 18 to provide a more defined weakening of the sealing function. This area is the weakest part of the seal. If any gas escapes during the opening of the bottle it will find this weakened area first. The weakened area is quite small, a typical rib having a width of the order of about one millimeter, but this is sufficient to enable relief of the pressure from the interior of the bottle before the rip tab 22 has been fully pulled along the rip line 27. Thus, there is little or no danger of the cap being blown off. The amount of beverage lost or discharged is a minimum. As the side wall 12 is torn further along the rip line 27 therafter thereafter no gas escapes because at least a major portion of the pressure already has been relieved.

It should be noted that even though the crimping action will crush the rib 38 at the crease 68, the groove beneath the upper part of the rib 38 will still be the weakest portion across the ring 18.

Figure 8:
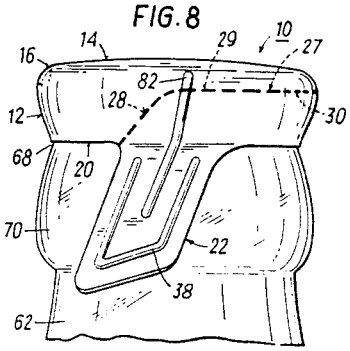
FIG. 8 is a fragmentary side elevational view of another modified form of the invention installed on the top of a bottle.
Figure 9:
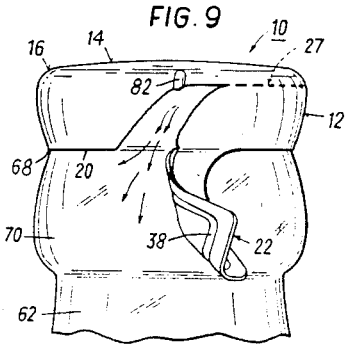
FIG. 9 is a view similar to that of FIG. 8 but showing the manner in which the rip tab is pulled to open the bottle.

In FIGS. 8 and 9 the rip tab 22 has a different arrangement of ribs. Here the U-shaped rib 38 does not extend past the rib line 27 and functions to strengthening and stiffening the rip tab. A central single rib 82 is provided functioning to relieve pressure during the opening process. Rib 82 crosses the rip line 27 and extends well up the side wall 12 to the upper portion of the bead at the rounded juncture 16 and therefore reaches the sealing ring 18. In FIG. 9 the tab 22 is shown partially pulled away from the remainder of the closure cap 10 and the upper end of the rib 82 has been separated from its lower end. Arrows indicate that gas is escaping by way of the upper end of the passageway under the rib and or in its vicinity to relieve the pressure in the bottle. The user is protected from blow off of the cap and from being inundated with the sudden discharge of beverage from the bottle.

Figure 10:
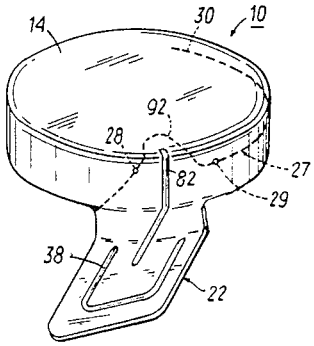
FIG. 10 is a perspective view of a modified form of the closure cap of the invention in which the center part of the rip line extends up onto the crown of the cap.

In FIG. 10 the center part 29 of the cap 10 differs from in that it has an upward excursion or diversion at 92 which well into the ring 18 and onto the crown 14. The manipulation of the rip tab 22 will open the bottle interior to the atmosphere when the excursion or diversion 92 is reached by lifting the sealing ring 18 in this area. In addition, this bulged excursion 92 serves to delay the tearing the rip line, thus giving the internal gas pressure more time to relieve.

Figure 11:
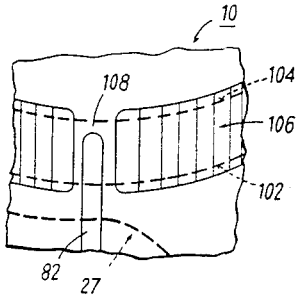
FIG. 11 is a fragmentary bottom plan view of a portion of a sheet metal blank in the process of being made into a closure cap of the invention having a special venting rib.

FIG. 11 shows an expident for assisting the escape of gas from the interior of the bottle between the metal surface of the cap and the ring 18 of sealing compound at the weakened line which was described above. The view is a fragmentary bottom view of a closure cap 10 in the flat. It has not been formed yet. At 82 there is illustrated the groove on the interior of a rib such as in FIGS. 8, 9 and 10. The parallel dash lines 102 and 104 represent the part where the ring 18 will be laid down. It is preferred to apply an adhesive in the form of a lacquer to the surface of the sheet only in an area 106 which is discontinuous as indicated at 108. Although the ring 18 will fill the groove on the back of rib 82, it will not adhere as well at the groove. Thus, as the rip line 27 separating the side wall 12 and intersects the rib 82 there is a greater likelihood that gas will escape by way of the weakened area at the groove between the ring and the metal surface than between the ring and the axial end 66 of the bottle.

When the closure cap is in place and pressure rises to the predetermined value, the gas may escape between the ring 18 and the axial end 66 of the bottle for self-venting. It is believed the resilience of the side wall 12 enables slight spreading of the bottom edge 20 as the closure cap rides up the bead 64. The cap raises slightly permitting gas to pass beneath the ring 18 and out the sides of the cap around the side wall 12.

For purposes of claiming the invention, it should be understood that the juncture 16 is an extension of the side wall 12 and hence reference to the side wall will include the junction. The word "beverage" is used to designate any liquid or slurry that is edible and sold or dispensed in bottles.

In the process of installing the closure cap of the invention upon a bottle of beverage which is under pressure and/or in the course of pasteurizing or sterilizing the contents by putting the bottle in an autoclave the crown 14 may bulge slightly from its originally flat planar configuration. The description of the crown 14 is intended to include this slight bulging of said crown and also crowns having a bulging or embossing made by deep drawing or embossing or the like.

The invention is capable of being embodied in closure caps made of steel suitably protected by coatings or plated to prevent corrosion, as well as other metals. It is preferable that the closure cap be formed of sheet aluminum or aluminum alloy in order to achieve the maximum of advantages of the invention. Aluminum and aluminum alloy closure caps are lighter in weight and more readily torn from the bottle.

Considerable variation can be made in the closure cap of the invention without departing from the spirit or scope of the invention as defined in the appended claims. The exact configuration of the rip tab can take many different forms; such as having a single rib-groove in the rip tab or above it or a series of ribs to provide a release of pressure when the closure cap is opened; the bottom flared end 20' may be used. Further the rip line may be formed by a series of perforations of the side wall material or may have one or more interruptions along its extent giving stops or delays effecting reduction in the speed of training of said rip line. The rip line may be described yet as having continuity thus including in its definition, a series of perforations. Also one can form the rip line of at least two parallel lines ets.

I claim:

1. A closure cap for a beverage bottle of the type which has a beaded rim including an annular axial end and an annular groove defined by the beaded rim where it terminates on the exterior or the bottle neck, the beverage when contained in the bottle after the closure cap has been installed thereon being at some time subjected to physical effects likely to increase the interior pressure in the interior space above the beverage, and said closure cap comprising:

A. a substantially cylindrical inverted dish-like member having a disc-shaped crown, a substantially cylindrical side wall defining a cylindrical jacket and a rounded annular juncture between the crown and the cylindrical jacket forming an interior fillet, said closure cap being engagable over the beaded rim of the bottle, and the cylindrical jacket having a vertical dimension sufficient to enable crimping thereof into engagement with the annular groove beneath said beaded rim, B. a rip tab having opposite side edges and a free end, said rip tab being connected to said lower edge of said jacket along a small fraction of the circumference of said lower edge thereof, said rip tab extending generally radially outwardly of said jacket when said rip tab is in a horizontal plane and adapted to be bent downwardly to lay close to the bottle neck when said closure cap is installed, C. a sealing member of gasket material disposed in said fillet on the interior of said dish-like member covering at least the upper portion of the interior of said cylindrical jacket and extending radially inwardly of said crown a distance at least sufficient to engage the annular axial end of the beaded rim of the bottle when installed, D. a rip line at least most of which is formed in said cylindrical jacket and extending with continuity having at least first and second portions, the first commencing at a location where a corner of one side edge of the rip tab and the lower edge of the cylindrical jacket meet, extending in a shallow rise from said lower edge and continuing circumferentially of said side wall toward the rounded annular juncture in a direction to pass the second side edge of the rip tab and the second portion commencing at a level located below the crown and continuing in said cylindrical jacket circumferentially at least about half-way around said jacket from the commencement of the rip line, E. said dish-like member and rip tab being integrally formed by metal working from readily bendable sheet metal so that the installed closure cap is capable of containment of the interior pressures while enabling facile opening of said closure cap by pulling said rip tab in a generally circumferential movement to sever the jacket along said rip line, F. and means for effecting controlled relief or internal pressure, said means comprising at least one groove formed on the inner surface of said cylindrical jacket, said groove located to avoid an acute angled intersection with said rip line.

2. The closure cap as claimed in claim 1, in which said level is at or slightly above the outermost diametrical extent of the beaded rim when the closure cap is in installed condition.

3. The closure cap as claimed in claim 1 in which said first and second portions of the rip line are connected to each other, none of said rip line portions reaching said rounded annular jucture, said rip line terminating with said second portion thereof spaced below said crown but within said cylindrical jacket.

4. The closure cap as claimed in claim 1 and a third portion of the rip line connecting said first and second portions of the tip line, said third portion having an excursion carrying the rip line at least into said rounded annular juncture.

5. The closure cap as claimed in claim 1 in which said closure cap is formed from sheet metal initially capable of work hardening to some extent upon formiung if not also upon installation and has a predetermined composition, thickness and tensile strength enabling the work hardening to provide resilience sufficient to cause self-venting and resealing of the closure cap when same is subject to a predetermined range of internal pressure subsequent to installation upon the bottle.

6. The closure cap as claimed in claim 1 in which the rip tab has an angled free end providing long and short side edges, the said aformentioned one side edge being said long side edge whereby to induce the user to pull the rip tab toward the short side edge.

7. The closure cap as claimed in claim 1 in which means are provided for controlled relief of internal pressure while the user is operating the rip tab to remove an installed closure cap from a bottle.

8. The closure cap as claimed in claim 7 in which said means comprise at least one of said grooves on the interior of the side wall in the vicinity of the rip tab and extending substantially vertically to and partially through said ring of gasket material whereby to provide a weakened area in the ring to permit gas relief from the interior of the bottle when the rip tab is pulled past the groove.

9. The closure cap as claimed in claim 8 in which said rip tab has upset rib means for strengthening said rip tab and said groove is formed under a portion of said rib means.

10. The closure cap as claimed in claim 1 in which said rip line is formed during the forming of said closure cap before installation as a tapered groove having a flat interior floor.

11. The closure cap as claimed in claim 1 in which the sheet metal is aluminum.

12. The closure cap as claimed in claim 11 in which the aluminum has a thickness on the order of 160 to 220 microns, and $a_2$ tensile strength on the order of 120 to 140 Newtons per $mm^2$.

13. The closure cap as claimed in claim 1 in which the rip line is formed on the interior of said closure cap.

14. The closure cap as claimed in claim 1 in which said rip tab has strengthening rip means at least adjacent the side edges thereof.

15. The closure cap as claimed in claim 14 in which there is a second groove formed on the interior of the cylindrical jacket substantially aligned with the center of said rip tab and extending across the rip line at a location speced from the upwardly directed portion thereof and upwardly at least into the annular ring of gasket material to provide controlled release of pressure from the interior of the bottle during the pulling of the rip tab to divide the cylindrical jacket at the rip line.

16. The closure cap as claimed in claim 1 in which said level is slightly above the outermost diametrical extent of the beaded rim when the closure cap is in installed condition.

17. A closure cap of aluminum or an aluminum alloy for use on containers, said closure cap including a disc-shaped cover having a cylindrical jacket with a rip tab and a rounded juncture therebetween, a ring of elastic sealing material disposed interior of the cap and lining essentially the upper half of the cylindrical jacket including the rounded juncture and the undersurface of the cover adjacent to the rounded juncture, the said cap having a rip line formed on the interior of the cap following a path commencing at one end of the rip tab across the rip tab area extending from the lower edge of the cylindrical jacket inside the cylindrical jacket and upwardly along a continuing path in a circumferentially directed arch, the path of the rip line reaching the upper part of the cylindrical jacket of the rounded jucture between the cover and the jacket, extending essentially parallel to the lower edge of the jacket, terminating at a location a distance of greater than approximately 140 deg from its commencing location, the angle defined between a line taken tangent to the rising portion of the rip line at any location along said rising portion and a plane taken normal to the axis of the cylindrical jacket always being less than 75 deg. at least one groove formed in the interior of the cylindrical jacket proximate to the rip tab and extending toward the rounded juncture, said one groove avoiding an intersecting relationship with the rising portion of said rip line and the closure cap being integrally formed by metal working, including drawing, of a metal band capable of being worked, said band having a thickness between 0.14 mm and 0.24 mm and, prior to the forming operation, a tensile strength between 90 and 220 Newtons/$mm^2$.

18. A closure cap as claimed in claim 17, wherein the thickness of the metal band is between 0.18 and 0.22 mm.

19. A closure cap as claimed in claim 17, wherein the tensile strength of the metal band is between 130 and 180 N/$mm^2$.

20. A closure cap as claimed in claim 17, wherein the rip line terminates at a location approximately 180 deg. from its commencement location.

21. Closure cap according to claim 17, wherein the aforementioned angle is always less than 45 deg.

22. Closure cap according to claim 17, characterized in that the rip line commences at a location near or at the first end of the rip tab contour at the edge of the cylindrical jacket, extends in a shallow arch upwardly in the direction of the cover and continues roughly from the level of the second end of the rip tab contour in a direction approximately parallel to the lower jacket edge.

23. The closure cap as claimed in claim 17 wherein there is a second groove formed on the interior of the cylindrical jacket and across the rip line at a location spaced from the rising portion thereof and extending into the rounded juncture.

24. The closure cap as claimed in claim 23 wherein there are plural plies of material at the rounded jucture whereby the installed cap is capable of temporarily expanding under a predetermined interior pressure for self-venting and resealing.

25. The closure cap as claimed in claim 17 wherein there are plural plies of material at the rounded juncture whereby the installed cap is capable of temporarily expanding under a predetermined interior pressure for self-venting and resealing.

26. In combination, a closure cap and a beverage bottle containing a beverage, there being a space in the bottle neck above the beverage, the beverage being at some time subjected to physical effects likely to increase the interior pressure in said space, said combination comprising:

A. a bottle of the type which has a beaded rim forming a mouthpiece, said rim having an axial annular end terminating in a groove formed on the bottle neck, the groove having a diameter substantially less than the outer diameter of the rim, B. a closure cap sealingly engaged onto the rim and formed of thin, bendable sheet metal and adapted to be removed from said bottle by tearing the closure cap in a generally circumferential stroke of the user, said closure cap comprising, i. an inverted dish-like member having a circular crown, a side wall connected to the crown and including a rounded juncture with said crown forming an interior fillet within the closure cap, the rounded juncture of said side wall being configured closely to engage against and follow the contours of the beaded rim a portion of the side wall having crimped engagement with said rim such that this portion of said side wall is tightly engaged in said groove, ii. a sealing member of gasket material in said fillet and having a lateral extent at least sufficient to engage said axial annular end and at least partially to extend down the side wall, said sealing member being sealed against said axial annular end, iii. a rip tab connected with the bottom edge of the side wall and extending generally downward along the bottle neck, the rip tab having opposite side edges and a free end, one side edge forming a corner with the bottom edge of the sidewall, iv. a rip line in the side wall formed of at least two parts and comprising a first part commencing at said corner and continuing in a rise circumferentially and toward said crown in a direction to pass said second side edge of the rip tab, the rip line also comprising a second part which is at a level spaced below said crown and spaced above said bottom edge and continuing at least about half way around the circumference of said side wall, v. means for controlled relief of internal pressure, comprising at least one rib on the outer surface of at least a part of said rip tab and the said side wall and forming a groove thereon, substantially all of said rise of said rip line being free from intersecting said rib.

vi. said closure cap including the dish-like member and rip tab being integrally formed from said bendable sheet metal, the closure adapted to be removed by a user grasping the free end of said rip tab and pulling the same in a generally circumferential stroke to tear the side wall apart along said rip line to relieve pressure, if any within said bottle and to enable said closure cap to be removed from said bottle after said rip line has been substantially traversed.

27. The combination as claimed in claim 26 in which the two parts of the rip line are connected, the first part rising to meet the second, the second terminating part within said side wall at a location approximately half way around the cap, and neither part being in said rounded juncture.

28. The combination as claimed in claim 26 in which the side wall when so engaged has substantially no visible corrugations therein.

29. The combination as claimed in claim 26 in which there is a weakened area transverse of said sealing member of gasket material access to which is had when said rip tab is pulled to separate the side wall along said rip line whereby to relieve pressure from said bottle by way of said weakened area.

* * * * *